US010473422B2

(12) United States Patent
Dyuzhev et al.

(10) Patent No.: US 10,473,422 B2
(45) Date of Patent: Nov. 12, 2019

(54) FLOBERT CARTRIDGE PISTOL

(71) Applicant: SCAmmo LLC, Blairstown, NJ (US)

(72) Inventors: Oleg Dyuzhev, Kharkov (UA); Yuri Naumov, Kharkov (UA); Oleg Seleznev, Moscow (RU); Vadim Kasvin, Fort Lee, NJ (US)

(73) Assignee: SCAmmo LLC, Blairstown, NJ (US)

( * ) Notice: Subject to any disclaimer, the term of this patent is extended or adjusted under 35 U.S.C. 154(b) by 0 days.

(21) Appl. No.: 15/949,374

(22) Filed: Apr. 10, 2018

(65) Prior Publication Data

US 2019/0310050 A1 Oct. 10, 2019

(51) Int. Cl.

| | |
|---|---|
| ***F41C 3/00*** | (2006.01) |
| ***F41A 19/48*** | (2006.01) |
| ***F41A 5/02*** | (2006.01) |

(52) U.S. Cl.

CPC ..... *F41C 3/005* (2013.01); *F41A 5/02* (2013.01); *F41A 19/48* (2013.01)

(58) Field of Classification Search

CPC .... F41C 3/005; F41A 5/02; F41A 5/00; F41A 5/12; F41A 19/48; F41A 19/14; F41A 19/24

USPC ..... 42/21; 89/29

See application file for complete search history.

(56) References Cited

U.S. PATENT DOCUMENTS 4,599,817 A * 7/1986 Scheible ..... F41C 3/12 42/1.15
5,359,937 A * 11/1994 Dittrich ..... F42B 14/064 102/430
5,983,773 A * 11/1999 Dionne ..... F41A 3/86 42/77
6,283,006 B1 * 9/2001 Szabo ..... F41A 17/26 42/69.03
6,634,128 B1 * 10/2003 Vastag ..... F41A 9/28 42/59
2002/0056359 A1 * 5/2002 Szabo ..... F41A 17/28 89/148
2011/0099870 A1 * 5/2011 Peev ..... F41A 19/32 42/69.01

OTHER PUBLICATIONS

Grand Power K22F MK12/1 Flobert Pistol 6mm, Commandohttp://www.commando.sk/zbrane/flobert-4mm-6mm/flobert-6mm/grand-power-k22f-mk121-flobert-pistol-6mm.

Grand Power K100F MK7/1 Flobert Pistol 6mm, Commandohttp://www.commando.sk/zbrane/flobert-4mm-6mm/flobert-6mm/grand-power-k100f-mk71-flobert-pistol-6mm.

Pistols under the patron of Flaubert: the first steps, http://gunmag.com.ua/pistolety-pod-patron-flobera-pervye-shagi/.

PMF-1 Makarov pistol under the Flaubert cartridge, http://guns-review.com/documents/review.php?entry_id=1405415205.

* cited by examiner

*Primary Examiner* — John Cooper

(74) *Attorney, Agent, or Firm* — Andrew H. Berks; Berks IP Law, PLLC

(57) ABSTRACT

A Flobert cartridge pistol with a barrel with a chamber, a slide, a receiver containing a hammer, a trigger, a decoupler, and an ammunition magazine in the handle of the pistol is disclosed. The double action trigger causes a Flobert round in the chamber to be fired, and the energy from the discharge of the round causes the slide to move back and the spent shell from the round to be ejected from the pistol, and engages a decoupling mechanism, which prevents the slide from cocking the hammer. The slide returns to its starting position, and the slide-return action strips a new round from the magazine and chambers the round, ready for firing.

3 Claims, 3 Drawing Sheets

FLOBERT CARTRIDGE PISTOL

FIELD OF THE INVENTION

The invention relates to a pistol with an ammunition magazine that fires Flobert cartridges.

BACKGROUND

The Flobert cartridge, also known as a .22 CB Cap (Conical Ball Cap) cartridge, is a variety of .22 caliber rimfire ammunition which has a very small propellant charge (usually no gunpowder, just the primer), resulting in a low muzzle velocity. The Flobert cartridge has a similar muzzle velocity as is produced by a low to mid-power .22 pellet gun, however the bullet from a .22 CB cartridge is significantly heavier than a typical air gun pellet and therefore carries more energy.

Flobert cartridge guns produce less noise than most guns and are useful where a low power cartridge is desirable, for example, in pest control or indoor target shooting. The .22 CB cartridge has not been popular in the United States, but has remained somewhat popular in Eastern Europe. In some countries, .22 CB weapons are in the category of air guns, so are not subject to gun laws. In recent years, there has been renewed interest in Flobert cartridge weapons as low cost training weapons and recreational shooting weapons with a minimal cost per shot.

As a training weapon for handling semi-automatic pistols, a Flobert cartridge pistol may be desirable as a low cost, low power weapon. A true semi-automatic pistol has a slide that is forced backwards from the recoil on firing a round. The backward action ejects the spent cartridge, and typically cocks the hammer for the next shot. A spring forces the slide back to its originally position. The return action strips a new cartridge from the ammunition magazine and chambers the round, ready for the next shot with the hammer cocked. However, the relatively small propellant charge of Flobert cartridges does not generate sufficient energy to force the slide back against the spring, eject the spent cartridge, cock the hammer for a new shot, and strip and chamber a new cartridge from an ammunition magazine.

In typical semi-automatic pistols, the hammer is cocked by the recoil action of the slide, so each trigger pull subsequent to the first shot is single action, meaning that the trigger only releases the cocked hammer. In a double action trigger pull, the first part of the trigger pull cocks the hammer, and a second step in the trigger pull releases the hammer to fire the shot. Most modern semi-automatic pistols have a double action trigger pull feature for the first round.

In some semi-automatic pistols, the slide recoil does not cock the hammer Thus, each trigger pull is double action, also called "double-action only." Examples of such weapons include the Kel-Tec P-11 and Sig Sauer P290RS Nitron Sub-Compact.

Most Flobert cartridge weapons available on the market are revolvers. Some of them are styled as Flobert cartridge pistols, but actually have a small revolver drum, which is characteristic for revolvers. For examples, see http://gun-mag.com.ua/pistolety-pod-patron-flobera-pervye-shagi and the PMF-1 Makarov pistol (http://guns-review.com/documents/review.php?entry_id=1405415205).

Other Flobert cartridge weapons styled as pistols do not have semi-automatic functions. For example, the "P1F ULTRA MK7/1" pistol uses bullet-shaped sleeve that each Flobert round must be inserted into (http://www.commando.sk/zbrane/flobert-4 mm-6 mm/flobert-6 mm/grand-power-plf-ultra-mk71-flobert-pistol-6 mm) This weapon also requires the user to manually pull the slide back after each discharge. That is, this pistol has no semiautomatic functions, making such pistols unsuitable for field firing practices.

SUMMARY OF THE INVENTION

The present invention provides a Flobert cartridge pistol with semi-automatic pistol features including a slide that recoils on firing a round and ejecting the spent shell, and reloading a new round from an ammunition magazine in the pistol handle. The inventive pistol has a hammer mechanism using a decoupler which disables the mechanical linkage of the hammer spring with the hammer after the round is fired. As a result, when a cartridge is discharged, the slide moves backwards and the spent cartridge is ejected without cocking the hammer. The hammer is cocked only when the trigger is pulled. That is, the trigger pull is a double-action for all shots. With this weapon, as with a semi-automatic combat pistol, the user does not need to manually reload after each shot.

The ammunition magazine is a conventional ammunition magazine that stores cartridges in a linear configuration. In an embodiment, the ammunition magazine is nested in the handle of a pistol.

In an embodiment, this invention provides a Flobert cartridge pistol having a barrel with a chamber, a slide, a receiver containing a hammer, a trigger, and an ammunition magazine in the handle of the pistol, wherein a trigger pull causes a Flobert round in the chamber to be fired, and the energy from the discharge of the round causes the slide to move back and causes the spent shell from the round to be ejected from the pistol, and wherein the slide returns to its starting position, and the slide-return action strips a new round from the magazine and chambers the round, ready for firing.

In an embodiment, this invention provides a Flobert cartridge pistol having a barrel with a chamber, a slide, a receiver containing a hammer, a trigger, a decoupler, and an ammunition magazine in the handle of the pistol, wherein a trigger pull causes a Flobert round in the chamber to be fired, and the energy from the discharge of the round causes the slide to move back and causes the spent shell from the round to be ejected from the pistol, and wherein the slide returns to its starting position, and the slide-return action strips a new round from the magazine and chambers the round, ready for firing, and wherein the decoupler prevents the slide from cocking the hammer.

DETAILED DESCRIPTION

The inventors have established experimentally that the discharge of a Flobert cartridge produces enough recoil to move a slide backward, to extract the spent case and return the slide under the force of the return spring to feed the next cartridge, but is not sufficient to cock the hammer.

Accordingly, in an embodiment of the present invention this problem is solved by mechanically decoupling the hammer spring arming process from the process of recoiling of the moving parts. A decoupler employed in the design of the hammer mechanism disables the mechanical linkage of the hammer spring with the hammer immediately after the hammer strikes the cartridge during the firing sequence. Consequently, the hammer spring is not engaged by the force of the slide moving backwards. The hammer is cocked only using the force of the shooter squeezing the trigger, or optionally the hammer may be cocked by the shooter manually.

As Flobert cartridges are designed with a strongly protruded rim, the classical scheme for feeding cartridges from the magazine case is inapplicable. The bullet extraction force is extremely low (approx. 0.5 to 1 N), which makes such cartridge sensitive to the forces of inertia associated with the operation of automatic mechanisms.

The Flobert shell is made of sheet metal and its side body and shell mouth are easily deformed when compressed in the weapon structural elements. The shells are therefore subject to deformation that could cause jams or misfires. To prevent this, the cartridges are placed and fixed in the weapon by a guiding and retaining mechanism by clasping the rim of the shell base, which is the hardest part of the case. The cartridges are displaced when feeding and ramming for the minimum distances required for the operation conditioned by the cartridge length and diameter, with the speeds which exclude self-induced extraction of the bullet under the forces of inertia/momentum. The required displacement speeds of the moving parts are provided by matching the strains of the return spring and the magazine case follower spring.

The breech block is connected to the slide to allow a longitudinal displacement that opens the breech on discharge of a round. At the end of the recoil, the breech block reaches a stop and remains motionless while the slide continues moving backwards allowing a fresh cartridge to push upward from the magazine case under the force of the magazine case follower spring and enter the open breach against the cartridge bearing surface of the breech block. Meanwhile, when the slide reaches its stop, the slide moves forward by the action of the return spring and together with the breech block rams the cartridge from the cartridge bearing surface of the breech block and moves it into the chamber.

Figure 1:
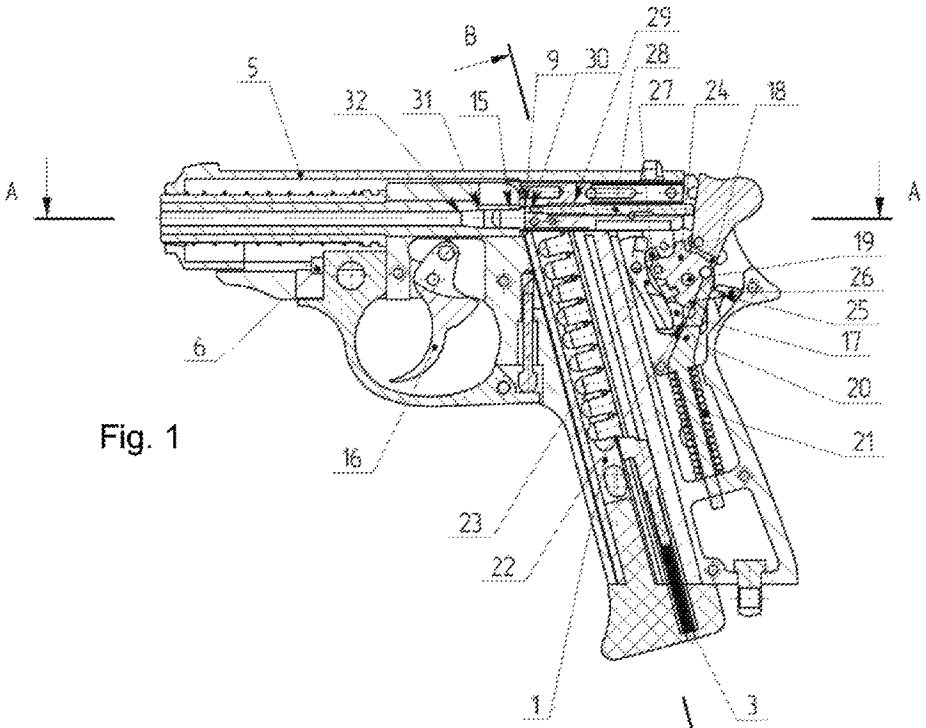
FIG. 1 shows a vertical section view of a pistol in accordance with one embodiment of the present invention.
Figure 2:
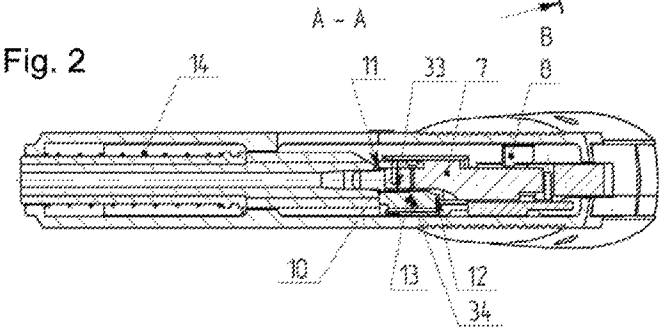
FIG. 2 shows a horizontal section along axis A-A of the breach block of a pistol in accordance with one embodiment of the present invention.

With reference to the figures, the terms "up", "down", "above", "below", "rear" and "front" are all descriptors of relative positions of parts when the inventive pistol is oriented with the barrel pointed as shown in FIG. 1. That is, the front of the weapon is the left in FIG. 1, and the rear is on the right in FIG. 1.

In an embodiment of this invention, as shown in the figures, a semi-automatic pistol is provided, comprising a barrel 35, a receiver with an opening for a magazine case 1 to be inserted, a hammer mechanism and a breech block 7. The hammer mechanism is equipped with a hammer 18, a hammer spring 21, a trigger 16, a tie rod (trigger bar) 17, and a decoupler 27, which decouples the hammer spring 21 from the hammer 18, by disabling the mechanical linkage of the hammer 18 and the hammer base 24. The decoupler 27 is installed in the hammer base 24 and when engaged by a cam 23, fixed on the receiver, it can rotate around the hammer axis 19 and interact with the bulge 22 on the tie rod 17.

Figure 3:
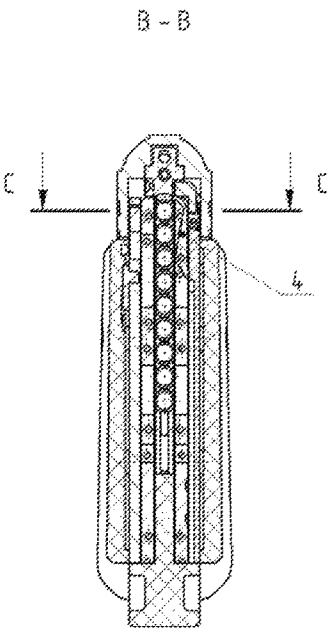
FIG. 3. shows a vertical section view along axis B-B of the pistol frame in accordance with one embodiment of the present invention, showing the magazine and the lock.

A lock 4 is located at the upper side of the magazine which prevents a cartridge from being pushed out of the magazine case 1 by a follower spring 3 (FIG. 3). When the magazine case 1 is installed into the pistol, the lock 4, interacting with the pistol receiver, is pulled aside and does not prevent cartridges from releasing. When pulling out the magazine case 1, the lock 4 is activated.

Figure 4:
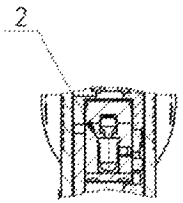
FIG. 4. shows a horizontal section view along axis C-C of the magazine in accordance to one embodiment of the present invention with a cartridge inside.

Cartridges are loaded into the magazine case 1 with the cartridge rim placed into a T-shaped groove guiding mechanism 2 of the magazine case 1 (FIG. 4).

Figure 5:
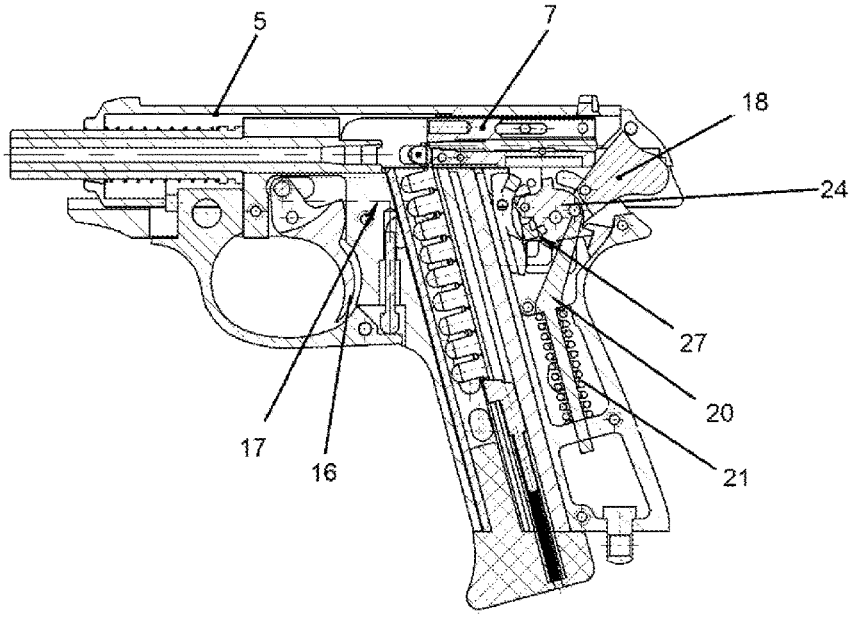
FIG. 5 shows a vertical section view of a pistol in the slide back position in accordance with one embodiment of the present invention.

Having installed the loaded magazine case 1 into the pistol, the shooter, similar to using a combat pistol, pulls back the slide 5 manually into its maximum rearward position at slide stop 6 (FIG. 5). Pulling the slide back also moves breech block 7, which is withdrawn to its stop 8 with the cartridge bearing surface 9 facing the T-shaped groove of the guiding mechanism 2 of the magazine case 1. In this position, a cartridge is pushed out of the magazine case 1 by the follower spring 3 to the cartridge bearing surface 9 of the breech block 7 adjoining the breech face 10 by the base. The cartridge is positioned between the extractor 11 and a shaped recess 12 of the ejector 13 so that the cartridge rim is located under the hook of the extractor 11 and engaged by the recess 12 of the ejector 13, to prevent the cartridge from falling out. Upon release of the slide 5, the breech block 7 moves forward under the force of the return spring 14 and pushes the cartridge, located in the cartridge bearing surface 9 of the breech block 7, into the chamber 15. The breech is now locked and the pistol is ready for firing.

To fire a round, the trigger 16 is pulled. As a double-action trigger pull, there are two steps to the trigger pull.

Figure 6:
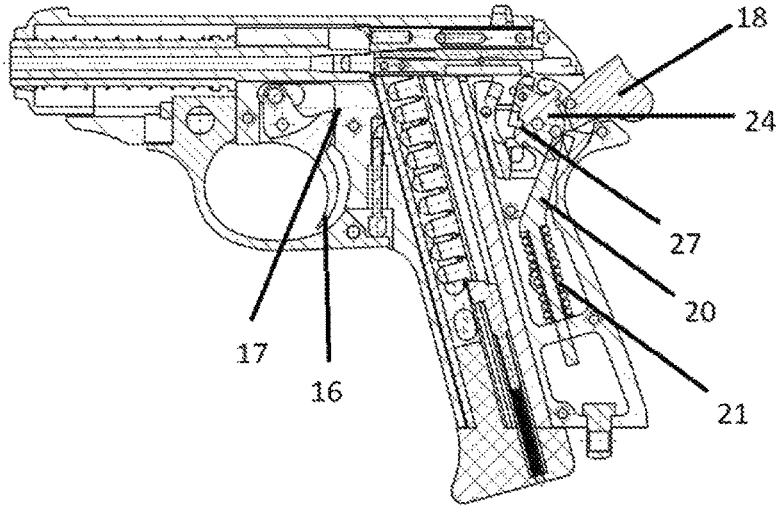
FIG. 6 shows a vertical section view of a pistol in hammer release position with the trigger pulled in accordance with one embodiment of the present invention.

In the first step, as depicted in FIG. 6, the force from the trigger 16 is transferred through tie rod 17 to hammer base 24 (FIGS. 5 and 6). The hammer base is configured so that the action of the tie rod rotates the hammer base about the axis 19, which causes the hammer 18 to rotate, engage the pusher 20, which compresses the hammer spring (main spring) 21. The hammer is now in the cocked position under tension and ready to fire a shot.

Figure 7:
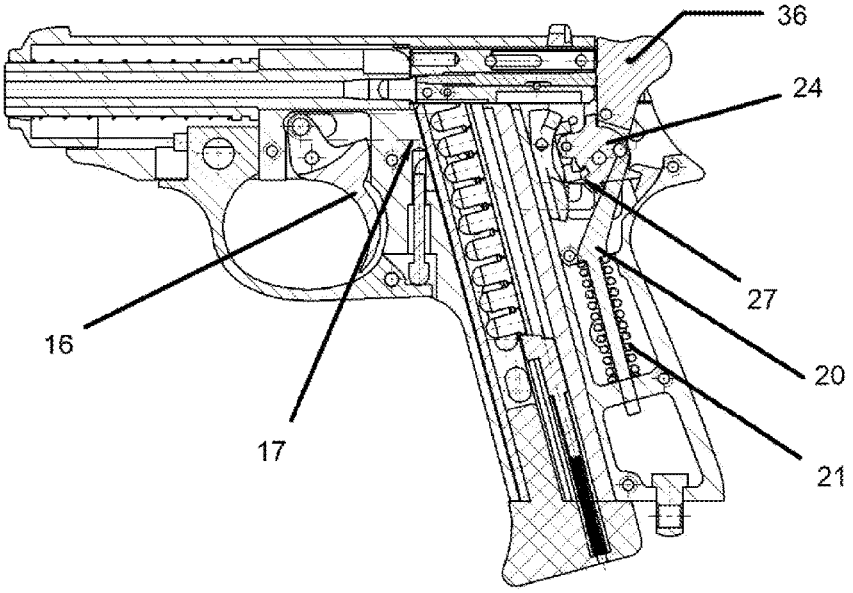
FIG. 7 shows a vertical section view of a pistol in the firing position in accordance with one embodiment of the present invention.
Figure 8:
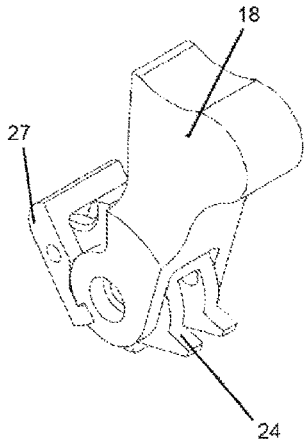
FIG. 8 shows a prospective view of the assembly of the decoupler, the hammer base and the hammer accordance with one embodiment of the present invention.

In the second step of the trigger pull, as depicted in FIG. 7, the hammer is released to fire the shot. As the shooter squeezes the trigger to the end of its stroke, a bulge 22 on the tie rod 17 displaces the cam 23 towards the hammer base 24. The cam 23 engages decoupler 27 which mechanically disconnects the tie rod from the hammer base. This causes the hammer base to rotate in the opposite direction under the force of the main spring 21 until the hammer thrust bulge 25 reaches the hammer stop 26. The hammer 18 is then released under the force of main spring 21 and strikes the firing pin 28 located in the seat 29 of the breech block 7 with sufficient force to fire the shot. The striker 30 on the firing pin strikes and deforms the cartridge rim and a shot is fired. As the hammer strikes the firing pin, the decoupler, which is in the engaged position, disconnects the main spring 21 from the hammer base 19.

Alternatively, in an embodiment as shown, the hammer 18 is external to the weapon and the hammer can be cocked manually by the shooter. If manually cocked, the trigger pull is single action only, i.e., only the second step of the trigger pull described above applies.

As the cartridge fires, the bullet affected by gas pressure exits the case and interacts with the conical forcing cone 31 in the barrel, that is designed to effectively amplify the gas pressure for the reliable extraction and recoiling of the moving parts. The cartridge's diameter decreases under the pressure which enables the cartridge to be expelled through the barrel throat 32.

Under the gas pressure acting on the case bottom and the breech face 10, the breech block 7 and the slide 5 move backwards, i.e., recoil. As the trigger 16 is still pressed down, and the cam 23 is engaging the decoupler 27, the hammer 18, released from the main spring 21, freely rotates about its axis 19. Thus, the recoil of the slide is not impeded by the hammer or the force of the main spring.

In the action that ejects the spent shell, the empty shell is engaged by the hook of the extractor 11 and cylindrical surface 33 of the ejector on the breech block 7. For facilitating the extraction the chamber has a conical shape. As the slide recoils, when the shell base reaches the ejector bulge 34 on the ejector and starts interacting with it, a rotational movement is transmitted to the shell around the point of contact with the hook of the extractor 11 that forces the shell away from the breech block 7 and out of the ejection port of the slide.

Having ejected the spent shell from the weapon, as the recoil continues, the breech block 7 reaches its stop 8 while the slide 5 is still moving backwards. At this point, the breech block is rearward of the ammunition magazine, and the next cartridge is pushed from the magazine case 1 to the breech block 7 and the loading cycle is repeated as previously described, with the return spring 14 forcing the slide back to the starting position. Optionally, the magazine lock 4 may prevent the slide from slide from moving forward if there is no ammunition remaining in the magazine.

Upon release of the trigger 16, the tie rod 17 goes back to its initial position. The decoupler is thereby disengaged, and tie rod re-couples with the hammer base 24, and cam 23 becomes disengaged which in turn releases the decoupler 27. The mechanical linkage between the hammer 18 and the main spring 21 is restored and the pistol is ready for a new shot.

The invention claimed is:

1. A Flobert cartridge pistol comprising a barrel with a chamber, a slide, a receiver containing a hammer, a trigger, a decoupler, and an ammunition magazine configured to be received in a handle of the pistol, the magazine configured to house one or more Flobert rounds, wherein a trigger pull causes a Flobert round in the chamber to be fired, and energy from the discharge of the Flobert round causes the slide to move back and causes a spent shell from the Flobert round to be ejected from the pistol, and wherein the slide returns to the slide starting position via a spring, and the slide-return action strips a Flobert round from the magazine and chambers the Flobert round ready for firing, and wherein the decoupler prevents the slide from cocking the hammer.

2. The Flobert cartridge pistol of claim 1, wherein the decoupler disables the mechanical linkage between the hammer and a hammer base.

3. The Flobert cartridge pistol of claim 2, wherein the decoupler is installed in a hammer base and when engaged by a cam fixed on the receiver rotates around the hammer axis, and periodically interacts with a bulge on a tie rod.

* * * * *